US008981867B2

(12) United States Patent
Schulz et al.

(10) Patent No.: US 8,981,867 B2
(45) Date of Patent: Mar. 17, 2015

(54) COUPLING BETWEEN A WAVEGUIDE AND A FEED LINE ON A CARRIER PLATE THROUGH A CROSS-SHAPED COUPLING ELEMENT

(75) Inventors: Christian Schulz, Bochum (DE); Michael Gerding, Bochum (DE); Michael Deilmann, Essen (DE)

(73) Assignee: KROHNE Messtechnik GmbH, Duisburg (DE)

( * ) Notice: Subject to any disclaimer, the term of this patent is extended or adjusted under 35 U.S.C. 154(b) by 260 days.

(21) Appl. No.: 13/431,513

(22) Filed: Mar. 27, 2012

(65) Prior Publication Data

US 2012/0262247 A1 Oct. 18, 2012

(30) Foreign Application Priority Data

Apr. 1, 2011 (DE) ..... 10 2011 015 894

(51) Int. Cl.
*H01P 5/107* (2006.01)

(52) U.S. Cl.
CPC ..... *H01P 5/107* (2013.01)
USPC ..... 333/26; 333/21 A

(58) Field of Classification Search
CPC ..... H01P 5/107
USPC ..... 333/26, 21 A
See application file for complete search history.

(56) References Cited

U.S. PATENT DOCUMENTS 2,829,348 A 4/1958 Kostriza et al.
5,043,683 A * 8/1991 Howard ..... 333/21 A
5,471,664 A * 11/1995 Kim ..... 455/323
5,781,161 A * 7/1998 Kinoshita et al. ..... 343/756
6,580,335 B1 * 6/2003 Iizuka et al. ..... 333/26
7,463,109 B2 12/2008 Iio
8,089,327 B2 1/2012 Margomenos et al.
2005/0200424 A1 * 9/2005 Takeda et al. ..... 333/26
2007/0222668 A1 9/2007 Schultheiss et al.

FOREIGN PATENT DOCUMENTS

DE 10 2007 057 211 A1 5/2009
EP 0 071 069 A2 2/1983
JP 2007-013450 A 1/2007

OTHER PUBLICATIONS

S. Maci and G. Biffi Gentili, Dual-Frequency Patch Antennas, IEEE Antennas and Propagation Magazine, vol. 39, No. 6, Dec. 1997, pp. 13-20.

* cited by examiner

*Primary Examiner* — Benny Lee
(74) *Attorney, Agent, or Firm* — Roberts Mlotkowski Safran & Cole, P.C.; David S. Safran

(57) ABSTRACT

A waveguide coupling, in particular for a radar level indicator having a waveguide, a carrier plate and at least one feed line, wherein the waveguide is placed on a first side of the carrier plate on the carrier plate, the feed line is guided on and/or in the carrier plate into the inner area of the waveguide and the feed line terminates with an end in the inner area of the waveguide. The carrier plate is continuous in the inner area of the waveguide and thus extends beyond the end of the feed line, an electrically conductive coupling element is arranged near the end of the feed line on and/or in the carrier plate, so that the coupling element is capacitively coupled with the feed line and the coupling element serves to couple electromagnetic waves led into the waveguide via the feed line in the waveguide.

11 Claims, 4 Drawing Sheets

COUPLING BETWEEN A WAVEGUIDE AND A FEED LINE ON A CARRIER PLATE THROUGH A CROSS-SHAPED COUPLING ELEMENT

BACKGROUND OF THE INVENTION

1. Field of the Invention

The present invention relates to a waveguide coupling and in particular to a radar level indicator having a waveguide, a carrier plate and at least one feed line, wherein the waveguide is placed on a first side of the carrier plate, the feed line is routed on and/or in the carrier plate into the inner area of the waveguide and the feed line terminates with an end in the inner area of the waveguide.

2. Description of Related Art

Waveguide couplings of the type to which the invention is directed have been known for a long time in high frequency engineering and they are used as an interface between an electronic device creating an electromagnetic signal and feeding the conducted signal into the inner space of the waveguide. In waveguide couplings known from the prior art, the carrier plate normally is formed of a conventional printed circuit, wherein the feed line is often designed as a microstrip line and is led through a recess in the waveguide into the inner space of the waveguide, where the conducted electromagnetic wave is separated from the feed line and spreads as a guided electromagnetic wave in the waveguide. In use as a radar level indicator, the guided electromagnetic wave can finally leave the waveguide also as a free wave, either directly after exiting the waveguide or after passing through an emitting device attached to the waveguide, which is often provided for achieving a certain emitting characteristic; in the last case, the waveguide serves as a kind of transition element. The form of the waveguide as well as the fed electromagnetic signal determines which modes of an electromagnetic wave finally spread in the waveguide. Normally, electromagnetic waves with frequencies in a GHz range are used for radar applications.

It is known from the prior art, that the material of the carrier plate surrounding the feed line in the inner area of the waveguide is removed—for example, by means of milling—so that the end of the feed line is practically uncovered. This method is comparably complex since, in particular, for high-frequency electromagnetic waves, the resulting structures are small, and thus, mechanically damageable, so that great demands are placed on the precision of the milling to be carried out. This type of construction is known, for example, from Brumbi, D.: "Grundlagen der Radartechnik zur Füllstandmessung", 3$^{rd}$ revised edition, 1999.

SUMMARY OF THE INVENTION

It is thus a primary object of the invention to provide a waveguide coupling that is very sturdy and is simple to produce.

The above object is met with the waveguide coupling described in the introduction in that the carrier plate is continuous also in the inner area of the waveguide and thus extends beyond the end of the feed line, that an electrically conductive coupling element is arranged near the end of the feed line on and/or in the carrier plate, so that the coupling element is capacitively coupled with the feed line and the coupling element serves to couple electromagnetic waves led into the waveguide via the feed line in the waveguide. Since the carrier plate also continuously extends into the inner area of the waveguide, i.e., practically represents a continuous plate, the step of uncovering the end of the feed line that ends in the inner area is omitted. Furthermore, mechanically damageable structures are avoided. Due to the electrically conductive coupling element near the end of the feed line, it is possible to adapt the waveguide coupling, and for example, to influence the bandwidth at the desired center frequency of the electromagnetic waves to be guided.

In a preferred design of the invention, it has been found to be advantageous when the coupling element is arranged essentially in the center of the waveguide on and/or in the carrier plate. When it is stated that the feed line is routed on and/or in the carrier plate or that the coupling element is arranged on and/or in the carrier plate, then it is meant that the electrically conducive elements do not necessarily have to be implemented on the surface of the carrier plate, but rather can also be implemented as conductive structures in a printed circuit board, as is known for example, in multi-layer boards.

A cross shape has been found to be a particularly suitable structure for the coupling element, so that the coupling element has a longitudinal bar and a cross bar, wherein the longitudinal bar and the cross bar are arranged in the shape of a cross. The longitudinal bar and the cross bar do not, of course, have to be differentiated into individual, overlapping structures, but rather can be present as a single structure, in which it can only be differentiated geometrically that there is a longitudinal bar and a cross bar. The cross shape of the coupling element includes an unexpected positive effect in respect to the achievable and achieved bandwidth. While bandwidths of normally not more than about 10% of the carrier frequency at an adaptation of better than 15 dB are achieved in common constructions, bandwidths of about 20% of the carrier frequency can be achieved with the described cross-shaped coupling element, which has substantial advantages.

By varying the length of the longitudinal bar and the length of the cross bar, the bandwidth can, for example, be varied, with which an adaptation above a predetermined damping can be achieved at a desired center frequency.

The coupling element is preferably designed in such a manner that the characteristic size of the coupling element lies in the range of one quarter of the wavelength of the electromagnetic waves to be emitted. "Characteristic size" means, for example, the longitudinal and transverse lengths of the coupling element, in the case of a cross-shaped design of the coupling element, i.e., the length of the longitudinal bar and the cross bar of the coupling element. At any rate, the effective relative permittivity of construction is to be taken into account here—for example, resulting from the relative permittivities of the carrier plate and surrounding air—since these are used as a scaling factor, wherein the scaling factor is more exactly the reciprocal of the root of the effective relative permittivity.

In a preferred design of the invention, it is provided that the carrier plate has the feed line, the coupling element and an electrically conducting screen face on its first side, on which the waveguide is located or on its second side, opposite the first side, or in an intermediate layer. Of course, the electrically conducting screen face and the feed line are implemented separate from one another, wherein the feed line, the coupling element and the screen face are implemented, in particular, as a metallization of the carrier plate. It is appropriate to carry out the production of these electrically conducting structures in the common, photolithographic manner, since it is easily possible here to carry out the required precision in the execution of the structures even in the range of fractions of millimeters.

According to an advantageous further development, the electrically conductive screen face contacts the waveguide on its end face, wherein the screen face surrounds the waveguide in a particularly extensive manner. Since the electrically conductive waveguide is joined at its end face with the screen face, which is also electrically conductive, it is very easily possible to place the screen face and the waveguide at a common electrical potential, for example, at ground potential.

It has also been shown to be advantageous when the carrier plate has an extensive, further electrically conductive screen face on its first side, on which the waveguide is located or on its opposite second side or in an intermediate layer and this screen face is preferably outside of the area to which the inner cross section face of the waveguide is opposed, wherein the further screen face is implemented, in particular, as a metallization of the carrier plate or as a metallic intermediate layer. In this manner, the entire surface of the carrier plate can be simply provided with a defined potential and interference can be suppressed.

In the scope of the invention, it has been acknowledged that it is surprisingly simple to suppress undesired modes in the waveguide. This can be achieved in that the screen face and/or the further screen face extend(s) into the inner cross section of the waveguide with an influencing extension, wherein the influencing extension is directed, in particular, toward the center of the inner cross section of the waveguide, preferably in line with the feed line. Here, the influencing extension remains near the circumference of the inner cross section face of the waveguide despite its orientation in the direction of the center of the cross section face of the waveguide, i.e., does not extend into the area of the coupling element.

In order to achieve a termination of the waveguide in the direction opposite the direction of emission, either a conductive cap can be placed on the second side of the carrier plate in a geometrical continuation of the waveguide, wherein the electrically conductive cap contacts, in particular, the extensive screen face arranged on the second side of the carrier plate or the further screen face with its end face. Alternatively, however, it can also be provided that the carrier plate has an electrically conductive layer as a termination of the waveguide on its opposite second side, —or, in turn, in an intermediate layer—as a continuation of the waveguide. In both variations, a distance from the termination of the waveguide to the coupling element is preferably implemented, which is also one quarter of the wavelength of the guided electromagnetic wave.

In a further preferred embodiment of the invention, it is provided that the waveguide and/or the cap are filled with a casting compound, wherein the permittivity of the dielectric used as casting compound is to be taken into account in sizing the structures that are involved in creating and guiding the desired electromagnetic waves. In a waveguide coupling filled with a casting compound, it is of particular advantage when the carrier plate in the area of the inner cross section face of the waveguide has at least one recess—for example in the form of a drilled hole—since an, initially liquid, casting compound can spread into all areas of the waveguide coupling through these recesses.

In detail, there are a number of possibilities for designing and further developing the waveguide coupling according to the invention. Here, please refer to the following detailed description of embodiments in conjunction with the accompanying drawings.

DETAILED DESCRIPTION OF THE INVENTION

Figure 1:
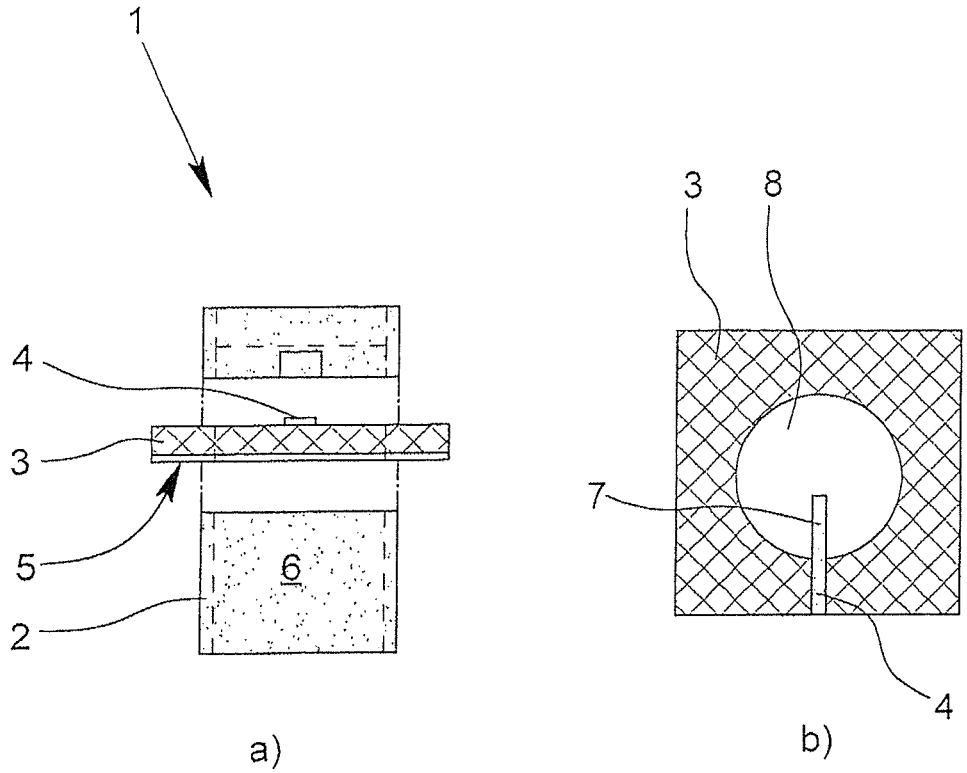
Fig. 1 (Prior Art)
FIGS. 1*a* & 1*b* show a waveguide coupling known from the prior art in a side view and a top view, respectively.

A waveguide coupling 1 known from the prior art is shown in FIGS. 1*a* & 1*b*, wherein FIG. 1*a* shows a waveguide 2, a carrier plate 3 and a feed line 4. The waveguide 2 is placed on the first side 5 of the carrier plate 3 in the mounted state, which is indicated by a dotted line in FIG. 1*a*.

The feed line 4 is guided on the carrier plate 3 into the inner area 6 of the waveguide; this is the case at least in the mounted state. The feed line 4 thus terminates with an end 7 (FIG. 1*b*) in the inner area 6 of the waveguide 2 (FIG. 5), when viewed in the axial direction of the waveguide 2, and thus, is actually provided on an outer end in the irradiation area of the waveguide 2. In FIG. 1*b*, it can be easily seen that the end 7 of the feed line 4 terminates in the inner area 6 of the waveguide (which is not shown in FIG. 1*b*) and is uncovered there, namely extends into a milled recess 8. It is easy to imagine that the end 7 of the feed line 4 is complex to produce, and moreover, mechanically very easily damaged.

Figure 3:
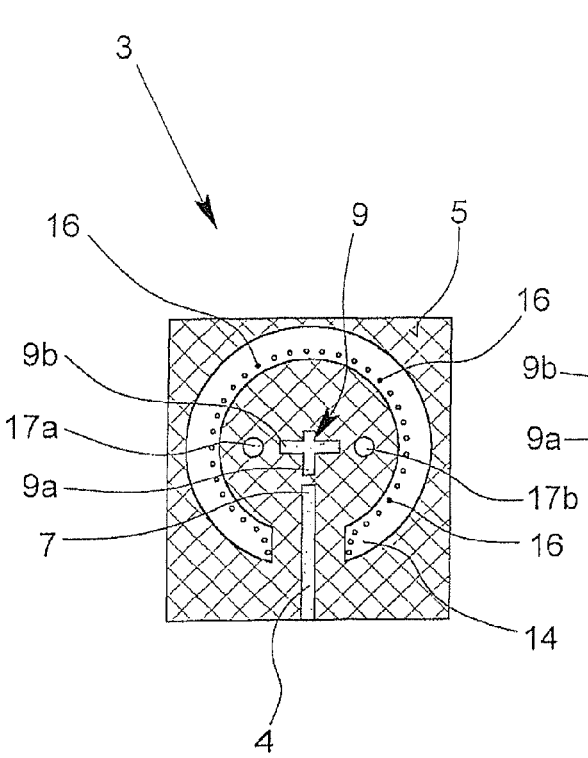
Figure 4:
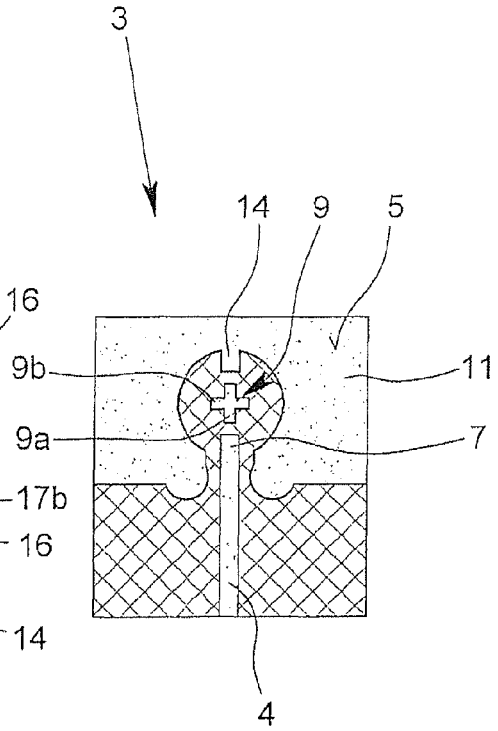
Figure 5:
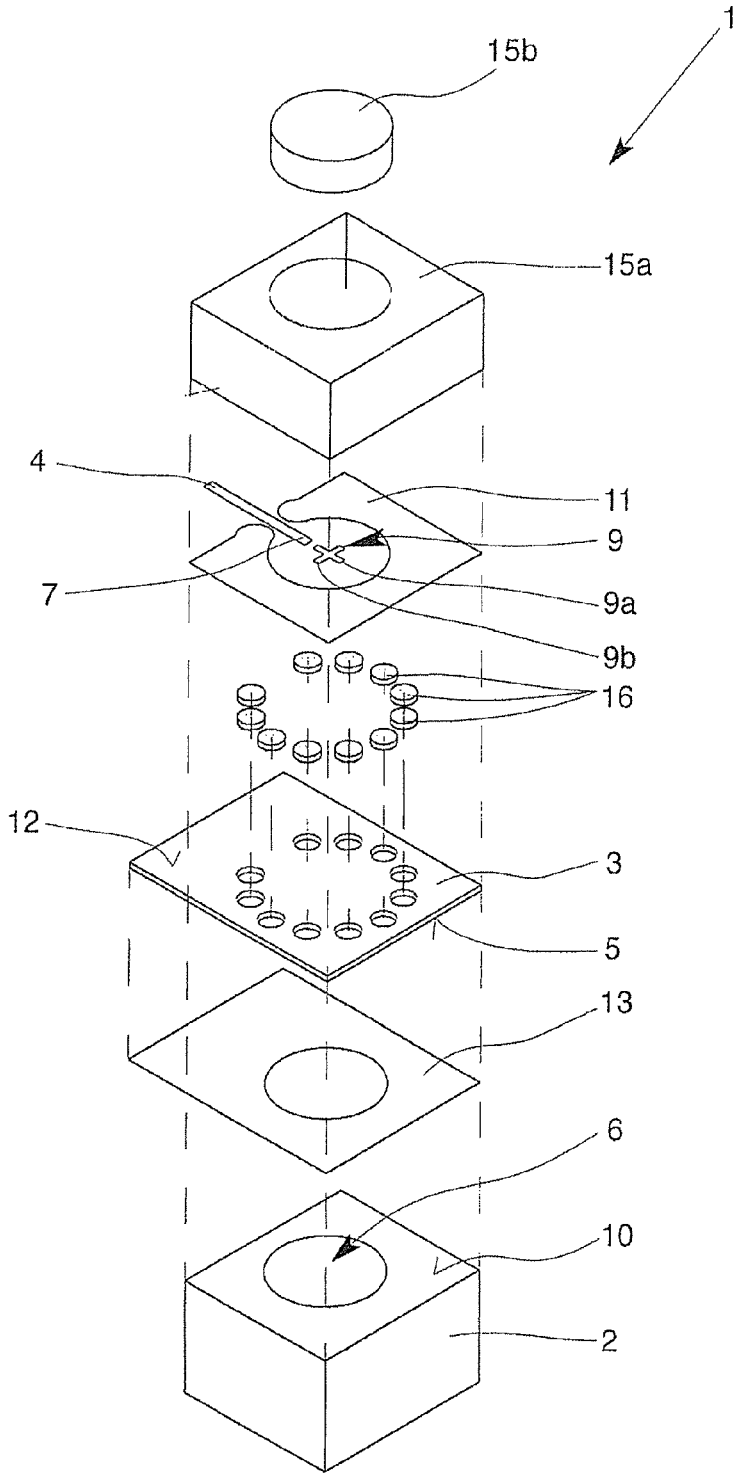

FIGS. 2*a*, 2*b* & 3 to 5 show waveguide couplings 1 or components of such waveguide couplings 1 according to the invention. As opposed to the waveguide coupling known from the prior art, as shown in FIG. 5, the carrier plate 3 continuously extends into the inner area 6 of the waveguide 2 in the embodiments according to FIGS. 2*a*, 2*b* & 3 to 5, so that the end 7 of the feed line 4 is not uncovered, i.e., there is no recess in the carrier plate 3 fitted for the contour of the end 7 of the feed line 4 in the inner area of the waveguide. Thus, the complex step of producing a precise breakthrough of the carrier plate 3 is omitted. Furthermore, it can be seen in FIGS. 2*a*, 2*b* & 3 to 5 that an electrically conductive coupling element 9 is provided near the end 7 of the feed line 4 on the carrier plate 3, wherein the expression "near the end 7 of the feed line 4" is to be understood as meaning that the coupling element 9 is capacitively coupled with the feed line 4 or with the end 7 of the feed line 4 and the coupling element 9 serves to couple electromagnetic waves guided via the feed line 4 into the waveguide 6 (FIG. 5).

The shaping of the coupling element 9 is decisive for the adaptation of the waveguide coupling, wherein regardless of the shape of the coupling element 9, it is advantageous when—as is shown in FIGS. 2*a*, 2*b* & 3 to 5—the coupling element 9 is arranged essentially in the center of the waveguide 2 on the carrier plate 3 (FIG. 5); in this manner, the electromagnetic waves emitted from the coupling element 9 are emitted practically symmetrically in respect to the walls of the waveguide 2.

It is provided in the embodiments that the coupling element 9 has a longitudinal bar 9*a* and a cross bar 9*b*, wherein the longitudinal bar 9*a* and the cross bar 9*b* together form a cross. Good adaptation of the waveguide coupling 1 is primarily implemented by the longitudinal bar 9*a*, wherein further, improvements of the adaptation of smaller scale are achieved with the cross bar 9*b*.

In the shown embodiments, the characteristic size of the coupling element 9 lie in a range of about one quarter of the wavelength of the electromagnetic waves to be determined, wherein the characteristic size, in this case, are each the length of the longitudinal bar 9*a* and the cross bar 9*b*.

It can be seen in FIGS. 2*a* and 3 to 5 that the feed line 4 is directed essentially straight toward the center of the inner cross section face of the waveguide 2, in the case of a round waveguide 2, it extends radially, wherein the longitudinal bar 9*a* of the coupling element 9 is arranged in an extension of the feed line 4.

Figure 2:
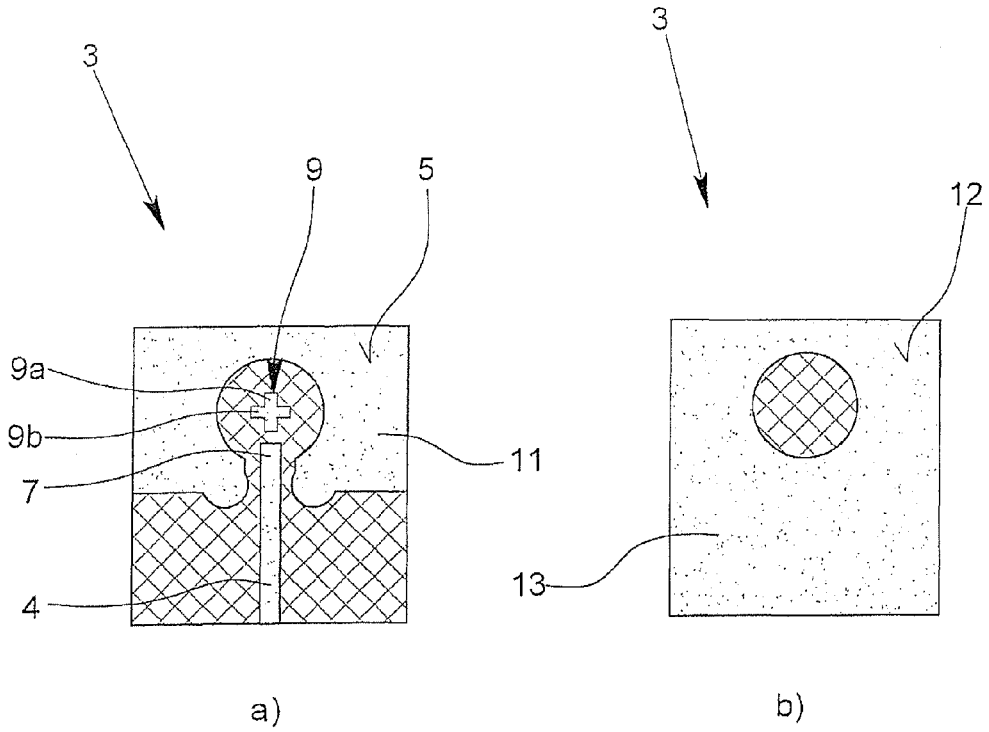
FIGS. 2*a*, 2*b* show a carrier plate of a waveguide coupling according to the invention from the first side and from the second side, respectively, in a top view, FIG. 3 a further embodiment of a carrier plate for a waveguide coupling according to the invention, FIG. 4 a further embodiment of a carrier plate for a waveguide coupling according to the invention and FIG. 5 an exploded view of a waveguide coupling according to the invention.

The embodiments shown in FIGS. 2*a*, 2*b* & 4 are wherein the carrier plate 3 has the feed line 4, the coupling element 9 and an extensive, electrically conductive screen face 11 that contacts the waveguide at its end face 10—not shown in FIGS. 2*a*, 2*b* & 4—on its first side 5, on which the waveguide 2 is located in the mounted state—not shown in FIGS. 2*a*, 2*b* & 4—wherein the feed line 4, the coupling element 9 and the screen face 11 are implemented as metallization of the carrier plate 3. In FIGS. 2*a*, 2*b*, in particular FIG. 2*b*, it is shown that the carrier plate 3 has a further extensive, electrically conductive screen face on its second side 12 (FIGS. 2*b* & 5) opposing the first side 5 and this screen face is outside of the area to which the inner cross-section face of the waveguide is opposed, wherein the further screen face 13 (FIGS. 2*b* & 5) is also implemented, in particular, as a metallization of the carrier plate 3.

The waveguide coupling 1 in FIG. 5 shows an exact antipodal construction of the configuration of the first side 5 and the second side 12 of the carrier plate 3. In the embodiment shown there, the waveguide 2 is also located on the first side 5 of the carrier plate 3, but the feed line 4 and the coupling element 9 are implemented on the second side 12 of the carrier plate 3 as metallization, which functions just as well; both shown solutions are technically equivalent and equally simple to produce.

In the embodiment shown in FIG. 3, no extensive screen face is provided, but rather just one electrically conductive contact face 14, on which the waveguide can be placed. In the carrier plate 3 according to FIG. 4, it is provided that the electrically conductive screen face 11 extends with an influencing extension 14 into the inner cross section of the waveguide, wherein the influencing extension 14 is arranged toward the center of the inner cross section face of the waveguide, presently namely in line with the feed line 4. The feed line 4, the longitudinal bar 9*a* and the influencing extension 14 lie along one line (FIGS. 3 & 4).

It is further shown in FIG. 5 that an electrically conductive connection is established between the waveguide 2 with end face 10 and the cap 15*a*, 15*b* using multiple through connections 16 (FIGS. 3 & 5) that are set in the carrier plate 3. The through connections 16 establish an electrically conductive connection between the electrically conductive screen face 11 on the one side of the carrier plate 3 and the further electrically conductive screen face 13 on the other side of the carrier plate 3. As has already been mentioned, it is not decisive for the technical function if the feed line 4, the coupling element 9 and the screen face 11 are provided on the side of the waveguide 2 of the carrier plate 3 or on the side of the cap 15*a*, 15*b*; it is of similar little importance whether the further screen face 13 is provided on the side of the carrier plate 3 facing the waveguide 2 or on the other side of the carrier plate 3 facing the cap 15*a*, 15*b*. Through connections 16 are further shown also in FIG. 3.

The embodiment shown in FIGS. 2*a* and 2*b* is designed for the coupling of electromagnetic waves with a center frequency of 80 GHz, presently for coupling a linear polarized electromagnetic wave, wherein the waveguide is designed round and with an inner diameter of 2.6 mm, the longitudinal bar 9*a* and the cross bar 9*b* of the coupling element have a length of each 0.84 mm, and the carrier plate 3 has a edge length of about 6 mm. Using a clever form and size of the coupling element 9, it is possible to achieve an adaptation of better than 15 dB for a bandwidth of about 17 GHz or of 21% of the center frequency. It should be taken into account here that the specifications apply for a construction without a casting compound; with a casting compound, the relative permittivity of the casting compound should be additionally taken into account in the design.

The embodiment according to FIG. 3 is optimized for coupling a linear polarized electromagnetic wave with a center frequency of 6 GHz, wherein the waveguide—not shown—is round and designed with an inner diameter of 21.6 mm, the longitudinal bar 9*a* of the coupling element 9 has a length of 5.5 mm and the cross bar 9*b* of the coupling element 9 has a length of 7.4 mm and wherein the carrier plate 3 has an edge length of about 32 mm. In this embodiment, a casting compound with a relative permittivity of about 4 is used, which is also taken into account in the above-mentioned design. If the casting compound is not used or is substituted by a casting compound with a different relative permittivity, the dimensions need to be correspondingly adapted.

In FIG. 3, it is further shown that the carrier plate has recesses 17*a*, 17*b* in the area of the inner cross section face of the waveguide, which are primarily used for easier filling of the waveguide coupling 1 with a casting compound and designed as holes. These holes are simple to produce and do not impair the advantage of the shown embodiment of a waveguide coupling 1 with an otherwise continuous carrier plate 3, since holes are very easy to produce compared to a milled uncovering of the feed line 4.

What is claimed is:

1. Waveguide with a waveguide coupling, wherein the waveguide coupling comprises: a carrier plate having a first side and a second side, said second side being opposite to said first side, the waveguide being connected on said first side of the carrier plate and at least one feed line, the at least one feed line being routed at least one of on and in the carrier plate into an inner area of the waveguide and terminates with an end in said inner area; wherein the carrier plate is continuous in said inner area and extends beyond the end of the at least one feed line, wherein an electrically conductive coupling element is arranged near the end of the at least one feed line on the carrier plate at a location enabling the coupling element to be capacitively coupled with the at least one feed line and to couple electromagnetic waves from the at least one feed line into the waveguide, wherein said waveguide is connected to an electrically conductive screen face on said first side of said carrier plate, wherein a second screen face is located on said second side of the carrier plate, and wherein said second screen face has an influencing extension, the influencing extension being aligned in a direction toward a center of an inner cross-sectional face of said carrier plate.

2. Waveguide according to claim 1, further comprising an electrically conductive cap on said second side of said carrier plate, wherein said electrically conductive cap contacts said second screen face on said second side of said carrier plate.

3. Waveguide with a waveguide coupling, wherein the waveguide coupling comprises:

a carrier plate having a first side and a second side, said second side being opposite said first side, the waveguide being connected on said first side of the carrier plate and at least one feed line, the at least one feed line being routed at least one of on and in the carrier plate into an inner area of the waveguide and terminates with an end in said inner area; wherein the carrier plate is continuous in said inner area and extends beyond the end of the at least one feed line, wherein an electrically conductive coupling element is arranged near the end of the at least one feed line on the carrier plate at a location enabling the coupling element to be capacitively coupled with the feed line and to couple electromagnetic waves from the at least one feed line into the waveguide, wherein the coupling element is arranged in a center of an inner cross-sectional face of said carrier plate, wherein said coupling element has a longitudinal bar and a cross bar, said longitudinal bar and said cross bar being arranged in a cross shape, wherein said feed line is aligned toward said center of said inner cross-sectional face of said carrier plate and wherein the longitudinal bar of the coupling element is arranged along an imaginary extension of said feed line.

4. Waveguide according to claim 3, wherein said longitudinal bar and said cross bar having a length, in a range of a quarter of the wavelength of electromagnetic waves to be emitted taking into account the effective relative permittivity of the waveguide coupling.

5. Waveguide according to claim 3, wherein said coupling element and said at least one feed line both are located on one of said first and second sides of said carrier plate.

6. Waveguide according to claim 3, further comprising an electrically conductive screen face on the first side of the carrier plate, wherein said waveguide is connected said electrically conductive screen face.

7. Waveguide according to claim 6, wherein a second screen face is located on said second side of the carrier plate wherein an influencing extension of said second screen face is aligned in a direction toward the center of the inner cross-sectional face of the carrier plate.

8. Waveguide according to claim 7, further comprising an electrically conductive cap on the second side of the carrier plate, the cap forming a geometric continuation of the waveguide and having an end face which forms a termination of the waveguide in use, wherein the electrically conductive cap contacts the second screen face on the second side of the carrier plate.

9. Waveguide according to claim 8, wherein at least one electrically conductive connection is provided extending through the carrier plate.

10. Waveguide with a waveguide coupling, wherein the waveguide coupling comprises: a carrier plate having a first side and a second side, said second side being opposite to said first side, the waveguide being connected on said first side of the carrier plate and at least one feed line, the at least one feed line being routed at least one of on and in the carrier plate into an inner area of the waveguide and terminates with an end in said inner area; wherein the carrier plate is continuous in said inner area and extends beyond the end of the at least one feed line, wherein an electrically conductive coupling element is arranged near the end of the at least one feed line on the carrier plate at a location enabling the coupling element to be capacitively coupled with the at least one feed line and to couple electromagnetic waves from the feed line into the waveguide, wherein the coupling element has a longitudinal bar and a cross bar, wherein the longitudinal bar and the cross bar are arranged in a cross shape, wherein the waveguide is round with an inner diameter of about 2.6 mm, and wherein the longitudinal bar and the cross bar of the coupling element each have a length of about 0.84 mm and the carrier plate has an edge length of about 6 mm for coupling a linear polarized electromagnetic wave with a center frequency of 80 GHz.

11. Waveguide with a waveguide coupling, wherein the waveguide coupling comprises: a carrier plate having a first side and a second side, said second side being opposite to said first side, the waveguide being connected on said first side of the carrier plate and at least one feed line, the at least one feed line being routed at least one of on and in the carrier plate into an inner area of the waveguide and terminates with an end in said inner area; wherein the carrier plate is continuous in said inner area and extends beyond the end of the at least one feed line, wherein an electrically conductive coupling element is arranged near the end of the at least one feed line on the carrier plate at a location enabling the coupling element to be capacitively coupled with the at least one feed line and to couple electromagnetic waves from the feed line into the waveguide, wherein the coupling element has a longitudinal bar and a cross bar, wherein the longitudinal bar and the cross bar are arranged in a cross shape, wherein the waveguide is round and has an inner diameter of about 21.6 mm, wherein the longitudinal bar of the coupling element has a length of about 5.5 mm, wherein the cross bar of the coupling element has a length of about 7.4 mm, wherein the carrier plate has an edge length of about 32 mm, for coupling a linear polarized electromagnetic wave with a center frequency of 6 GHz, and wherein the waveguide coupling contains a casting compound having a relative permittivity of about 4.

* * * * *